US006622497B2

(12) United States Patent
Marques et al.

(10) Patent No.: US 6,622,497 B2
(45) Date of Patent: Sep. 23, 2003

(54) DEVICE FOR INDICATING THE FORMATION OF ICE IN REFRIGERATION APPLIANCES

(75) Inventors: Marco Eduardo Marques, Joinville-SC (BR); Gilmar Canali Ferreira, Joinville-SC (BR)

(73) Assignee: Multibras S.A. Eletrodomesticos, Sao Paul (BR)

( * ) Notice: Subject to any disclaimer, the term of this patent is extended or adjusted under 35 U.S.C. 154(b) by 0 days.

(21) Appl. No.: 10/169,304

(22) PCT Filed: Jan. 9, 2001

(86) PCT No.: PCT/BR01/00009

§ 371 (c)(1),
(2), (4) Date: Sep. 25, 2002

(87) PCT Pub. No.: WO01/51865

PCT Pub. Date: Jul. 19, 2001

(65) Prior Publication Data

US 2003/0074906 A1 Apr. 24, 2003

(30) Foreign Application Priority Data

Jan. 10, 2000 (BR) ..... PI 0000827-3
Oct. 30, 2000 (BR) ..... PI 0005655-3

(51) Int. Cl.[7] ..... F25B 49/00
(52) U.S. Cl. ..... 62/125; 62/129; 374/162
(58) Field of Search ..... 62/125, 129; 340/580; 374/161, 162, 159; 116/216, 335

(56) References Cited

U.S. PATENT DOCUMENTS

| | | | | | |
|---|---|---|---|---|---|
| 1,945,100 | A | | 1/1934 | Troll | 177/311 |
| 2,225,932 | A | | 12/1940 | Shaw | 62/1 |
| 2,571,787 | A | | 10/1951 | Tobey | 62/1 |
| 3,831,391 | A | * | 8/1974 | Blomstrand | 62/125 |
| 4,208,884 | A | * | 6/1980 | Popham | 62/282 |
| 4,299,095 | A | * | 11/1981 | Cassarino | 62/155 |
| 4,345,441 | A | | 8/1982 | Hansen | 62/140 |
| 4,348,869 | A | | 9/1982 | Massa | 62/140 |
| 4,407,138 | A | * | 10/1983 | Mueller | 514/216 |
| 4,615,179 | A | * | 10/1986 | Chiu et al. | 62/129 |
| 4,995,244 | A | * | 2/1991 | Steers et al. | 62/155 |
| 5,295,361 | A | * | 3/1994 | Novak et al. | 62/128 |
| 5,363,669 | A | * | 11/1994 | Janke et al. | 62/155 |
| 6,089,033 | A | * | 7/2000 | Dube | 62/156 |
| 6,525,641 | B1 | * | 2/2003 | Frank | 337/365 |

FOREIGN PATENT DOCUMENTS

| | | | |
|---|---|---|---|
| FR | 1494235 | 12/1967 | |
| FR | 2176422 | 10/1973 | G06F/3/02 |
| GB | 2284254 | 5/1995 | F25D/3/08 |

* cited by examiner

*Primary Examiner*—William E. Tapolcai
*Assistant Examiner*—Mohammad M. Ali
(74) *Attorney, Agent, or Firm*—Darby & Darby

(57) ABSTRACT

A device for indicating the formation of ice in refrigeration appliances, such as the refrigerators of domestic use, comprising a display, which is mounted inside the refrigeration cabinet and formed by a demarcated region, defined by a heat sensitive element, whose color is enhanced and distinguished when submitted to a determined temperature condition that is reached when said demarcated region is contacted by the layer of ice accumulated on the evaporator.

4 Claims, 3 Drawing Sheets

DEVICE FOR INDICATING THE FORMATION OF ICE IN REFRIGERATION APPLIANCES

FIELD OF THE INVENTION

The present invention refers to a device for indicating the formation of ice on the evaporator of refrigeration appliances, such as the refrigerators of domestic use, in order to give a visual indication to the user about the occurrence of a limit condition of ice accumulation, from which the performance of the refrigeration appliance is impaired.

BACKGROUND OF THE INVENTION

There are well known in the art the refrigerators in which the defrost operation is carried out either manually or semi-automatically, requiring the intervention of the user only to start the defrost procedure, since the end thereof is automatically achieved.

These refrigeration appliances may have problems in their performance in case the defrost is not effected periodically, in order to avoid that the progressive ice accumulation on the evaporator (which is usually of the plate type with a "C" shaped lateral profile and positioned in the inner upper portion of the cabinet) reaches such a level that the ice begins to act as an insulating element, impairing the heat exchange between the evaporator and the surrounding air, or as a blocking means against the circulation of air around the evaporator.

In these known refrigeration appliances, the necessary defrost operations are decided, either by the user himself, based on his observation of the level of ice accumulation, or by a periodic defrost program. Since the user does not receive any direct and clear visual indication about the existence of an anomalous and operatively unacceptable situation of ice accumulation, it is very common for these appliances of domestic use to work with efficiency loss. Disclosure

DISCLOSURE OF THE INVENTION

It is an object of the present invention to provide a device for indicating the formation of ice in refrigeration appliances, which may be easily installed in a visible place inside the refrigeration cabinet, in order to give the user a visual indication about the need for a defrost operation, due to the occurrence of a certain level of ice accumulation on the evaporator.

The present indicating device is applied into refrigeration appliances of the type comprising a refrigeration cabinet provided with a front door and lodging an evaporator.

According to the invention, the indicating device comprises a display, which is mounted inside the refrigeration cabinet, at a distance from the evaporator equivalent to a predetermined limit thickness of ice accumulation on said evaporator, and which is formed by a demarcated region, defined by a heat sensitive element of the Master, liquid crystal, paint, or similar types, whose color is enhanced and distinguished When submitted to a determined temperature condition that is reached whiten said region is contacted by the ice accumulated on the evaporator. With the constructive solution mentioned above, the formation of ice itself, which automatically thermically activates said heat sensitive region of the indicating device, gives the user a visual indication or alarm about the need for promoting the defrost of the refrigeration appliance.

BRIEF DESCRIPTION OF THE DRAWINGS

The invention will be described below, with reference to the appended drawings, in which.

BEST MODE OF CARRYING OUT THE INVENTION

Figure 1:
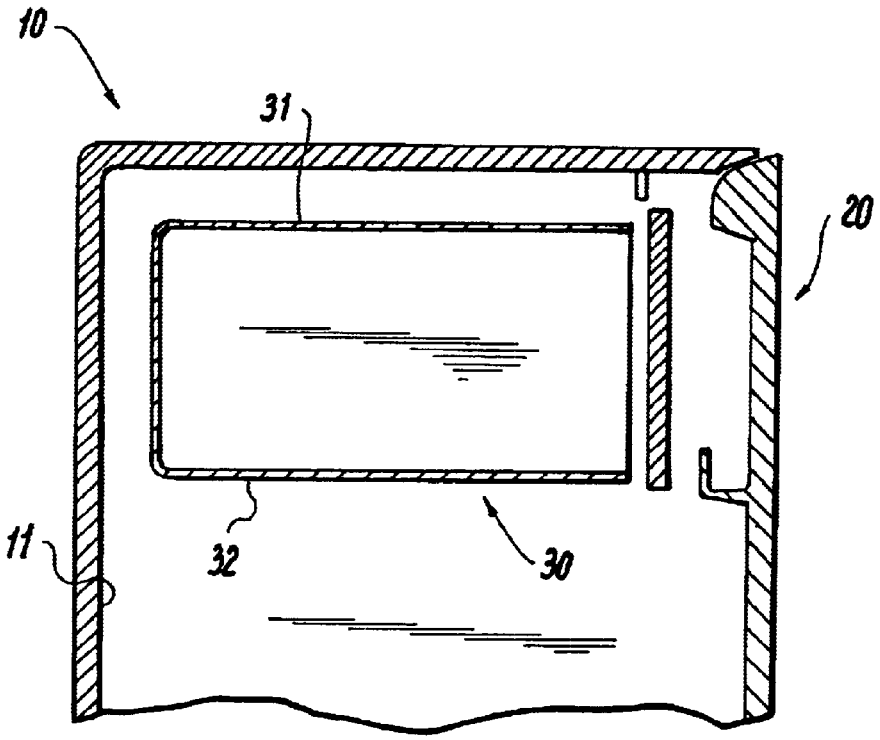
FIG. 1 is a partial vertical sectional view of a refrigerator with a refrigeration cabinet closed by a front door and internally provided with an upper evaporator, free from ice accumulated on its surface, and with the present indicating device.
Figure 2:
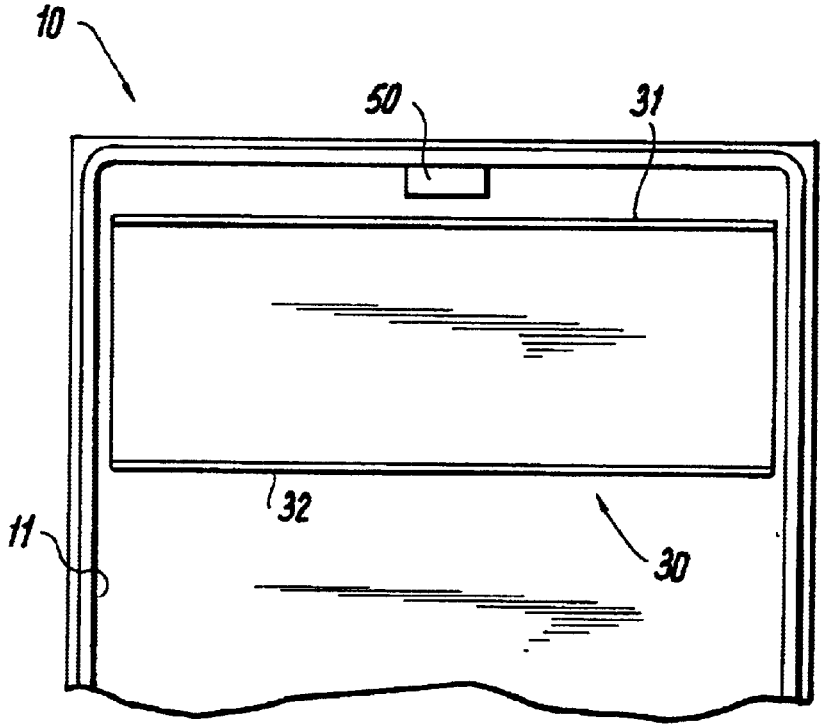
FIG. 2 is a front view of the assembly illustrated in FIG. 1, but without the front door of the refrigeration cabinet.
Figure 3:
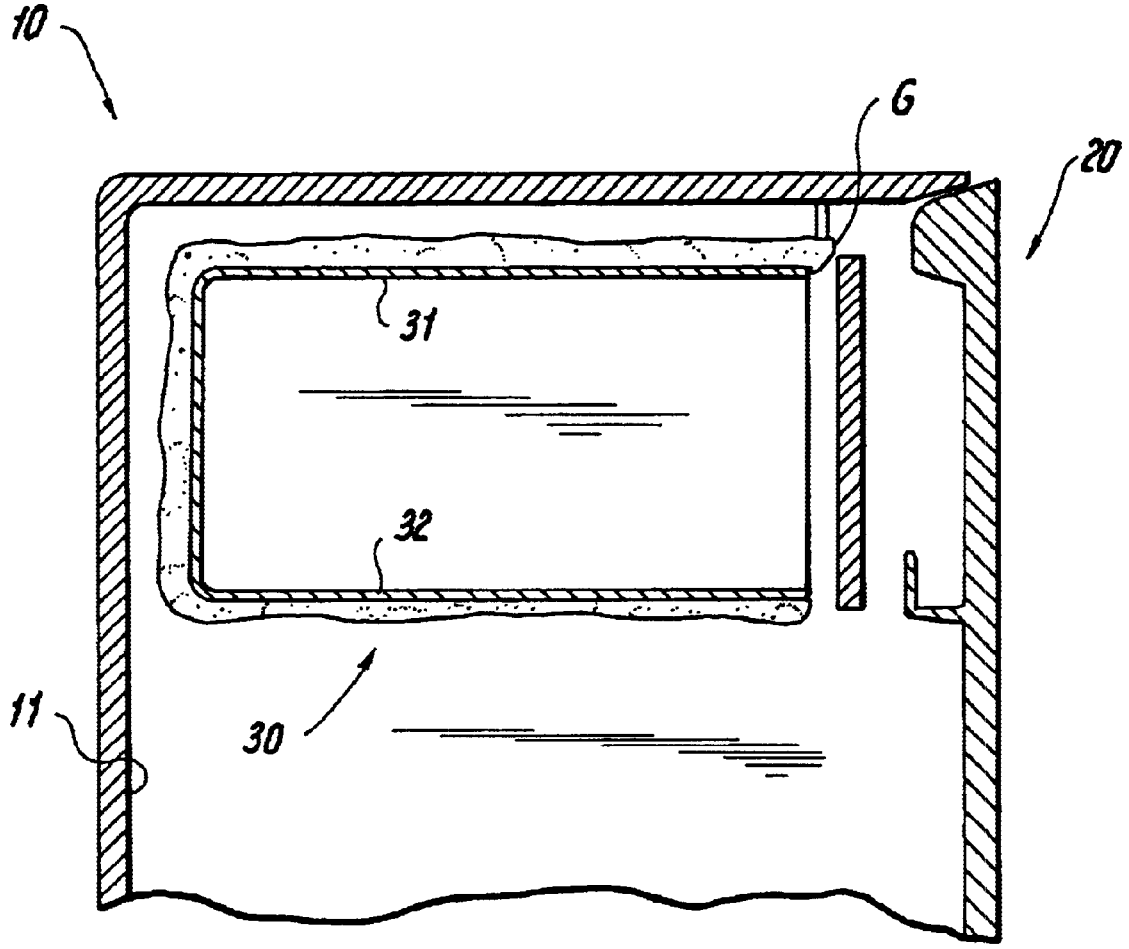
FIG. 3 is a similar view to that of the previous figure, but illustrating the evaporator surrounded by a layer of ice with a thickness sufficient to contact the heat sensitive region of the indicating device.
Figure 4:
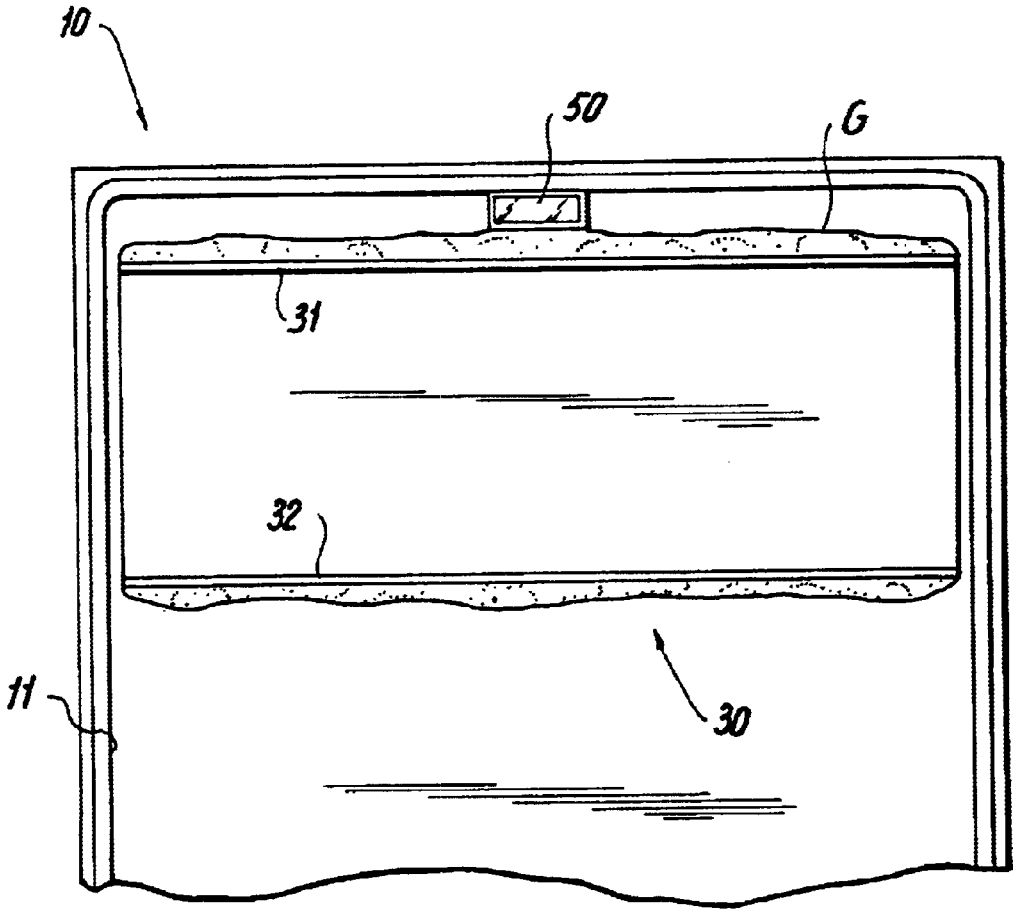
FIG. 4 is a front view of the assembly illustrated in FIG. 3, but without the front door of the refrigeration cabinet.
Figure 5:
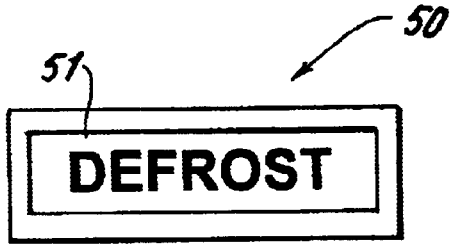
FIG. 5 is an enlarged front view of the indicating device of the present invention.

According to the appended drawings, the present device for indicating the formation of ice is applied to refrigeration appliances, usually refrigerators of domestic use and of the type comprising a refrigeration cabinet 10 closed by a front door 20 and lodging, inside its inner box 11, which is molded in a material with low thermal conductivity, an evaporator 30, which is provided in the upper part of the refrigerator and which is usually of the plate type with a "C", lateral profile, with an upper wall 31 and a rear wall 32 which are slightly spaced from the adjacent walls of the inner box 11, in order o allow air to circulate around the evaporator 30.

The present indicating device comprises a display 50 to be mounted inside the inner box 11 of the refrigeration cabinet 10 by any adequate arrangement.

The display 50 usually takes the form of a small plate made of metal or plastic material and affixed to the inner box 11 in a position that is both adjacent to the evaporator 30 and visible to the user when he opens the door 20.

In the illustrated arrangement, the display 50 is affixed to the inner box 11 at the front of and slightly above and spaced from the front edge of the upper wall 31 of the evaporator 30, onto which front edge the layer of ice G will accumulate more intensively, with the risk of reaching the adjacent wall of the inner box 11 and blocking the circulation of air around the evaporator 30.

The display 50 is formed by a demarcated region 51 defined by a heat sensitive element, generally of the Master, liquid crystal, paint, or similar types, whose color is enhanced and distinguished when submitted to a determined temperature which, in the present case, corresponds to a temperature that has been reached by said demarcated region when contacted by the layer of ice G formed on the evaporator 30.

Thus, the display 50 is positioned at a distance from the evaporator 30 corresponding to a limit thickness of the layer of ice G which, when reached, will require a defrost operation of the refrigeration appliance. When the ice accumulated on the evaporator 30 reaches said limit thickness, contacting the demarcated region 51 made of a heat sensitive element, the latter will be sensitized, enhancing and distinguishing its color, due to the fact that it has been cooled to a lower temperature than the usual operational temperature, i.e., to a temperature close to that of the formed ice, lower than the temperature of the surrounding air inside the refrigeration appliance 10.

The change in the aspect of the demarcated region 51 of the display 50 gives the user a clear indication about the need for promoting defrost in the refrigeration appliance.

As illustrated, the demarcated region 51 of the display 50 may be configured so that, when thermically activated, it defines a message indicating to the user the need for promoting defrost, by means of expressions, such as "defrost", "defrost now" or "time to defrosts".

While the present invention has been described and illustrated for an evaporator 30 of the plate type and having a "C" shaped lateral profile, it may as well be applied to evaporators with any other constructive form.

What is claimed is:

1. A device for indicating the formation of ice in refrigeration appliances, comprising a refrigeration cabinet (10) provided with a front door (20) and lodging an evaporator (30), and a display (50), which is mounted inside the refrigeration cabinet (10), at a distance from the evaporator (30) equivalent to a predetermined limit thickness of ice accumulation said evaporator, characterized in that said display (50) is formed by a demarcated region (51), defined by a heat sensitive element, whose color is enhanced and distinguished when submitted to a determined temperature condition that is reached when said demarcated region (51) is contacted by the layer of ice (G) accumulated on the evaporator (30).

2. Device, as in claim 1, wherein the evaporator (30) is of the plate type, with a "C" shaped lateral profile and whose upper wall (31) is slightly spaced from the adjacent upper inner wall of the refrigeration cabinet (10), characterized in that the display (50) is affixed inside the refrigeration cabinet (10) slightly above and spaced from the front edge of the upper wall (31) of the evaporator (30).

3. Device as in claim 1, Characterized in that the demarcated region (51) of the display (50) is configured so that, when thermically activated, it defines a message indicating to the user the need for promoting the defrost operation of the refrigeration appliance.

4. Device, as in claim 1, characterized in that the heat sensitive element is defined by one of the Master, liquid crystal, or paint types.

* * * * *

UNITED STATES PATENT AND TRADEMARK OFFICE

CERTIFICATE OF CORRECTION

PATENT NO. : 6,622,497 B2
DATED : September 23, 2003
INVENTOR(S) : Marcos Eduardo Marques et al.

It is certified that error appears in the above-identified patent and that said Letters Patent is hereby corrected as shown below:

Title page,
Item [30], Foreign Application Priority Data, delete "January 10, 2000" and substitute -- January 11, 2000 --.

Signed and Sealed this

Thirtieth Day of March, 2004

JON W. DUDAS
*Acting Director of the United States Patent and Trademark Office*